US006416442B1

(12) United States Patent
Stearns et al.

(10) Patent No.: US 6,416,442 B1
(45) Date of Patent: Jul. 9, 2002

(54) ELLIPTICAL EXERCISE METHOD AND APPARATUS

(76) Inventors: Kenneth W. Stearns, P.O. Box 55912, Houston, TX (US) 77055; Joseph D. Maresh, P.O. Box 645, West Linn, OR (US) 97068-0645

( * ) Notice: Subject to any disclaimer, the term of this patent is extended or adjusted under 35 U.S.C. 154(b) by 0 days.

(21) Appl. No.: 09/558,438

(22) Filed: Apr. 25, 2000

Related U.S. Application Data

(63) Continuation-in-part of application No. 08/991,757, filed on Dec. 16, 1997, now Pat. No. 5,919,118

(60) Provisional application No. 60/044,026, filed on May 5, 1997.

(51) Int. Cl.[7] ..... A63B 22/64

(52) U.S. Cl. ..... 482/52; 482/57; 482/70

(58) Field of Search ..... 482/51, 52, 53, 482/57, 70, 79, 80

(56) References Cited

U.S. PATENT DOCUMENTS

| | | | | | |
|---|---|---|---|---|---|
| 4,185,622 | A | | 1/1980 | Swenson | 128/25 B |
| 4,786,050 | A | | 11/1988 | Geschwender | 272/73 |
| 5,242,343 | A | | 9/1993 | Miller | 482/57 |
| 5,518,473 | A | | 5/1996 | Miller | 482/57 |
| 5,540,637 | A | | 7/1996 | Rodgers, Jr. | 482/52 |
| 5,562,574 | A | | 10/1996 | Miller | 482/51 |
| 5,577,985 | A | | 11/1996 | Miller | 482/52 |
| 5,593,372 | A | | 1/1997 | Rodgers, Jr. | 482/52 |
| 5,611,758 | A | | 3/1997 | Rodgers, Jr. | 482/57 |
| 5,692,994 | A | * | 12/1997 | Eschenbach | 482/57 |
| 5,707,321 | A | * | 1/1998 | Maresh | 482/57 |
| 5,769,760 | A | * | 6/1998 | Lin et al. | 482/52 |
| 5,779,599 | A | * | 7/1998 | Chen | 482/57 |
| 5,792,026 | A | * | 8/1998 | Maresh et al. | 482/70 |
| 5,919,118 | A | * | 7/1999 | Stearns et al. | 482/51 |

* cited by examiner

*Primary Examiner*—Stephen R. Crow

(57) ABSTRACT

An exercise apparatus has a linkage assembly which links rotation of a crank to generally elliptical movement of a foot supporting member. The crank rotates about a crank axis relative to a frame, and a distal portion of a link moves relative to a connection point on the frame. An intermediate portion of the link is rotatably connected to the crank, and an opposite distal portion of the link is rotatably connected to a rearward end of the foot supporting member. An opposite, forward end of the foot supporting member is movably connected to the frame.

29 Claims, 14 Drawing Sheets

Fig. 11
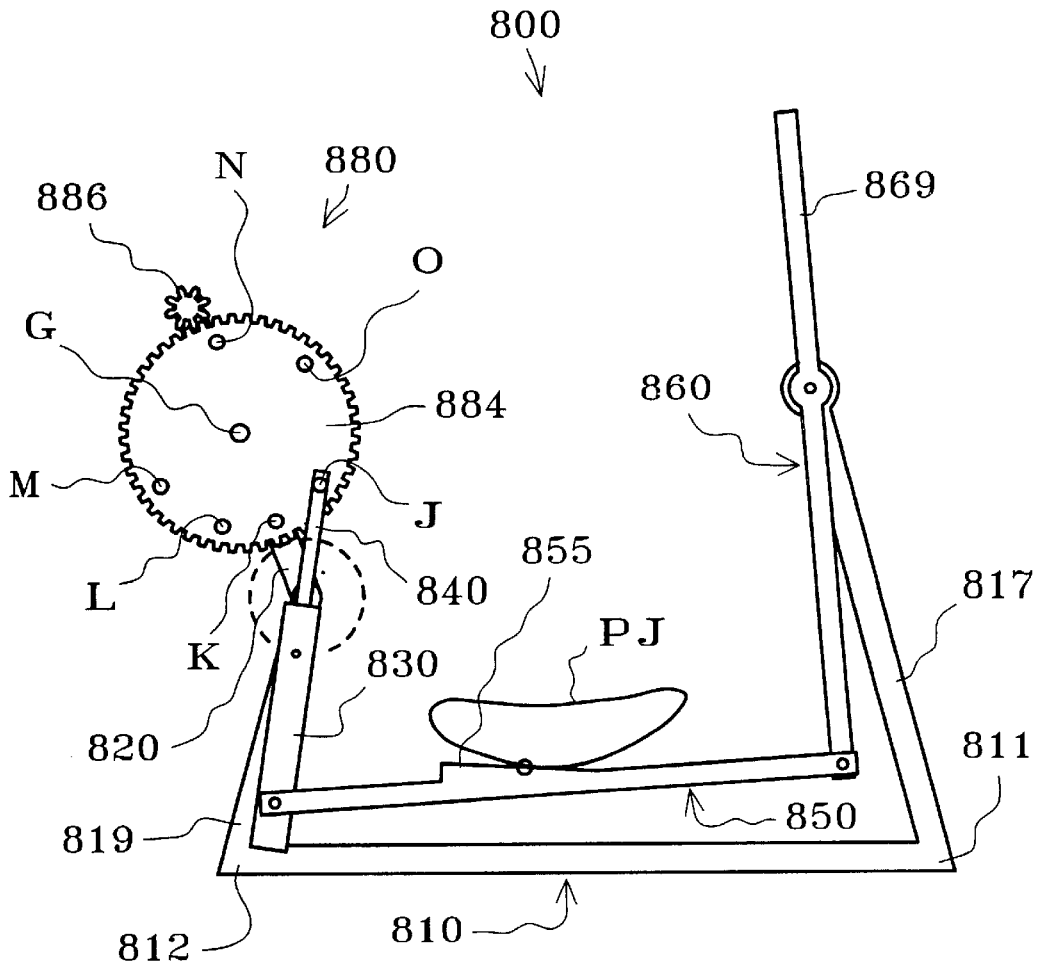
Fig. 11L
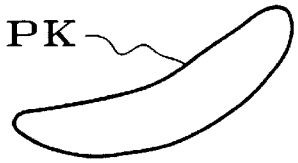
Fig. 11K
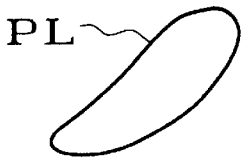
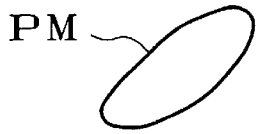
Fig. 11M
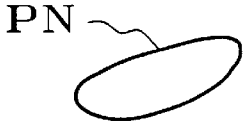
Fig. 11N
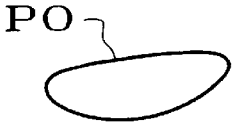
Fig 11 O

ELLIPTICAL EXERCISE METHOD AND APPARATUS

CROSS-REFERENCE TO RELATED APPLICATIONS

This application is a continuation-in-part of U.S. patent application Ser. No. 08/991,757, which was filed on Dec. 16, 1997, now U.S. Pat. No. 5,919,118; and also discloses subject matter entitled to the earlier filing date of Provisional Application Serial No. 60/044,026, filed on May 5, 1997.

FIELD OF THE INVENTION

The present invention relates to exercise methods and apparatus and specifically, to exercise equipment which facilitates exercise through a curved path of motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment facilitates relatively more complicated exercise motions and/or better simulates real life activity. Such equipment typically links a relatively simple motion, such as circular, to a relatively more complex motion, such as elliptical. However, room for innovation remains in this field.

SUMMARY OF THE INVENTION

The present invention may be seen to provide a novel linkage assembly and corresponding exercise apparatus suitable for linking circular motion to relatively more complex, generally elliptical motion. In one embodiment, for example, a crank is rotatably mounted on a frame; a connector link has a first distal portion which is rotatably connected to a first portion of a foot supporting member, an intermediate portion which is rotatably connected to the crank, and a second, opposite distal portion which is movably connected to the frame. A second portion of the foot supporting member is constrained to move in reciprocating fashion relative to the frame. A third portion of the foot supporting member is sized and configured to support a foot of a standing person and moves together therewith in a generally elliptical path relative to the frame.

The present invention may also be seen to provide a novel linkage assembly and corresponding exercise apparatus suitable for adjusting the size and/or orientation of such elliptical motion. In the embodiment described above, for example, the second distal portion of the connector link moves relative to the frame about a connection point which is selectively movable relative to the crank axis. The main or primary effect of moving the connection point radially relative to the crank axis is to change the length of the elliptical path traveled by the foot supporting member. The main or primary effect of moving the connection point tangentially relative to the crank axis is to change the inclination of the elliptical path traveled by the foot supporting member.

In another respect, the present invention may be seen to provide an alternative means for adjusting the orientation of the generally elliptical path of motion relative to a horizontal surface which supports the apparatus. In this regard, a rocker link is rotatably interconnected between the second portion of the foot supporting member and a moving member on the frame. A pin extends through the moving member and into engagement with one of a plurality of holes in the frame to selectively secure the moving member at a particular elevation above the horizontal surface. A relatively higher pin location results in a relatively more strenuous or "uphill" elliptical path.

In yet another respect, the present invention may be seen to provide a novel linkage assembly and corresponding exercise apparatus suitable for linking reciprocal motion to relatively more complex, generally elliptical motion. In this regard, the upper distal end of the rocker link is sized and configured for grasping by a person standing on the foot supporting member and is movable back and forth in an arc relative to the frame (or a moving member on the frame).

In still another respect, the present invention may be seen to provide an exercise apparatus that facilitates three different modes or combinations of exercising the upper body and the lower body. In this regard, a handle is rotatably mounted to the frame (or a moving member on the frame) and shares a common rotational axis with the rocker link. In a first mode of operation, the handle is locked to the frame, and the rocker link is free to pivot relative to both the handle and the frame, so that a person may grasp the stationary handle for support while moving the foot supporting member through the generally elliptical path of motion. In a second mode of operation, both the handle and the rocker link are free to pivot relative to the frame and one another, so that a person may grasp and selectively move the handle while moving the foot supporting member through the generally elliptical path of motion. In a third mode of operation, the handle is locked to the rocker link, and the combination is free to pivot relative to the frame, so that movement of the foot supporting member through the generally elliptical path of motion is linked to back and forth pivoting of the handle. In this third mode of operation, a person may grasp the handle and simply allow it to follow the prescribed path of motion, or help drive the handle through the prescribed path of motion, or even provide resistance to movement of the handle through the prescribed path of motion. Many features and/or advantages of the present invention may become more apparent from the following detailed description of the preferred embodiment.

BRIEF DESCRIPTION OF THE DRAWING

With reference to the Figures of the Drawing, wherein like numerals represent like parts throughout the several views.

FIG. 11 is a side view of still another embodiment of the present invention;

FIGS. 11K–11O are side views of foot paths selectively available on the exercise apparatus of FIG. 11;

DETAILED DESCRIPTION OF THE PREFERRED EMBODIMENT

Figure 1:
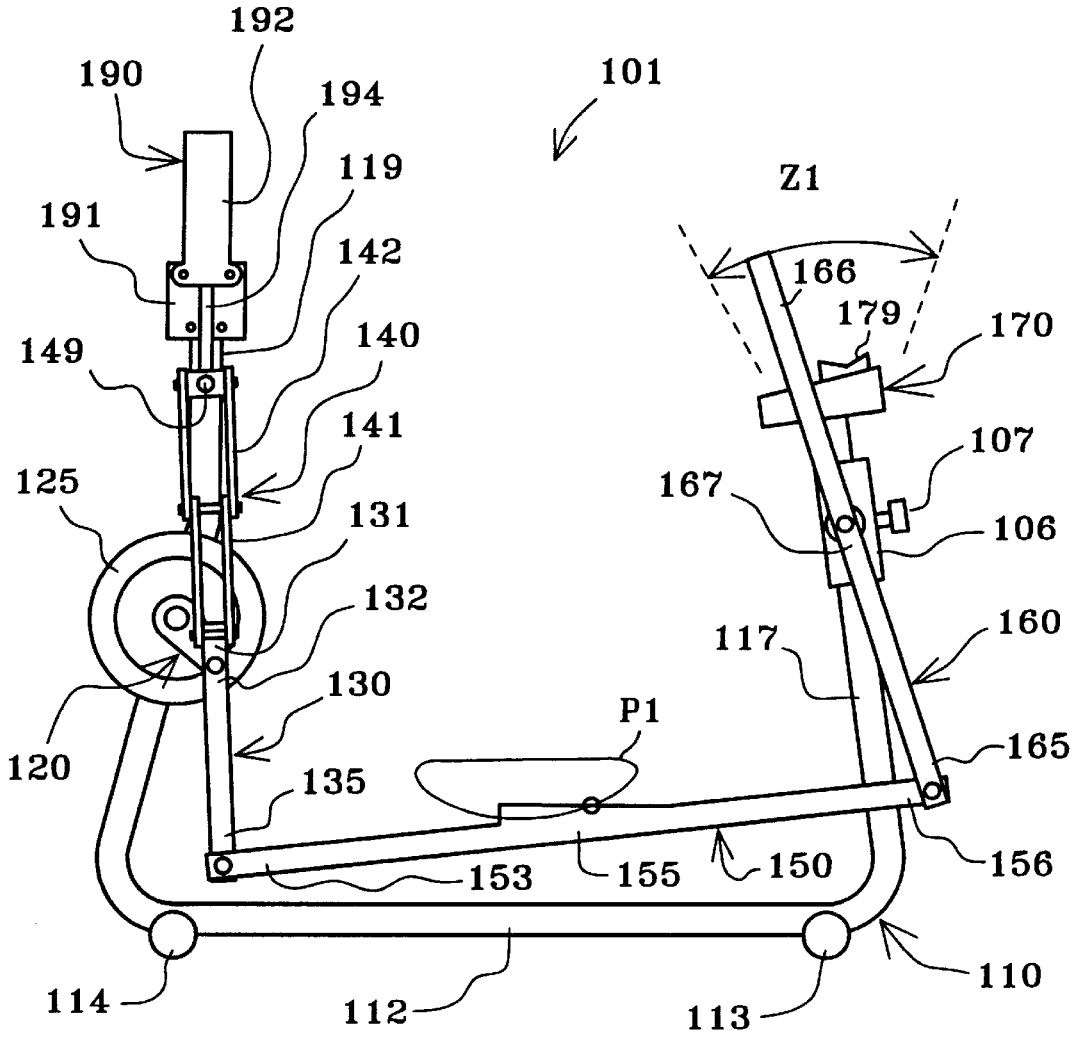
FIG. 1 is a side view of an exercise apparatus constructed according to the principles of the present invention.

A first exercise apparatus constructed according to the principles of the present invention is designated as 101 in FIG. 1. A second exercise apparatus constructed according to the principles of the present invention is designated as 102 in FIG. 2. As suggested by the common reference numerals, the exercise machines 101 and 102 are similar in many respects, and the same description is applicable to both machines except where specifically noted to the contrary.

Each exercise apparatus 101 and 102 generally includes a linkage assembly movably mounted on a frame. Generally speaking, the linkage assembly moves relative to the frame in a manner that links rotation of a crank to generally elliptical motion of a force receiving member. References to "elliptical" motion are intended in a broad sense to describe a closed path of motion having a relatively longer first axis and a relatively shorter second axis (which is perpendicular to the first axis).

The frame 110 or 110' generally includes a base 112 which extends from a forward end to a rearward end. For ease of discussion, reference may be made to "ends" and/or to "forward" or "rearward" portions of the apparatus and/or components thereof. However, those skilled in the art will recognize that the present invention is not limited to a strict interpretation of such terms. For example, it is understood that person could exercise while facing in either direction relative to the linkage assembly, and/or that the linkage assembly could be configured to accommodate exercise in an opposite direction.

A relatively forward transverse support 113 and a relatively rearward transverse support 114 cooperate to stabilize the apparatus relative to a horizontal floor surface. A first stanchion or upright support 117 extends upward from the base 112 proximate its forward end. A second stanchion or upright support 119 or 119' (unique to a respective embodiment 101 or 102) extends upward from the base 112 proximate its rearward end.

Each apparatus is generally symmetrical about a vertical plane extending lengthwise through the frame (perpendicular to the transverse ends 113 and 114 thereof), the only exceptions being the location of a resistance mechanism and the relative orientation of linkage assembly counterparts on opposite sides of the plane of symmetry. In particular, the "right-hand" components are one hundred and eighty degrees out of phase relative to the "left-hand" components (although other phase relationships may be implemented without departing from the scope of the invention). For ease of illustration, only the "right-hand" parts are shown on the apparatus, with the understanding that corresponding parts are disposed on the opposite or "left-hand" side of the apparatus. Those skilled in the art will also recognize that the portions of the frame which are intersected by the plane of symmetry exist individually and thus, do not have any "opposite side" counterparts.

Each linkage assembly generally includes left and right cranks 120; left and right connector links which include first, fixed length segments 130 and second, variable length segments 140; left and right foot supporting members 150; and left and right rocker links 160. Each crank 120 is rotatably mounted to the rear stanchion 119 or 119' via a common shaft. A flywheel 125 is also secured to the crank shaft and rotates together with the cranks 120 about an axis A1 relative to the frame. A drag strap (not shown) is secured about a circumferential groove on the flywheel 125 in a manner known in the art to resist rotation thereof. Other types of known resistance and/or inertia altering devices, including a "stepped-up" flywheel assembly, may be substituted for or added to that shown without departing from the scope of the present invention.

Each fixed length segment 130 is a rigid member having a first portion 131 which is connected to a respective variable length segment 140, a second portion 132 which is rotatably connected to a respective crank 120, and a third portion 135 which is rotatably connected to a rearward portion 153 of a respective foot supporting member 150. Those skilled in the art will recognize that the first portion 131 may coincide with the second portion 132 without departing from the scope of the present invention, and/or that the first portion 131 may alternatively be described as an intermediate segment disposed between the first segment 130 and the second segment 140. In any event, the fixed length member 130 is rotatable relative to the crank 120 and thereby defines an axis of rotation A2 which, in turn, is rotatable about the crank axis A1. Those skilled in the art will further recognize that the fixed length segment 130 and the variable length segment 140 may be described collectively as a variable length link.

Each variable length segment 140 includes a first part 141 and a second part 142 which pivot relative to one another about a first axis L1 that extends perpendicular to the crank axis A1. An opposite or distal end of the first part 141 is rotatably connected to the portion 131 and thereby defines a second axis of rotation L2 that extends perpendicular to the crank axis A1. An opposite or distal end of the second part 142 is rotatably connected to a joint member 149 and thereby defines a third axis of rotation L3 that extends perpendicular to the crank axis A1. The axes L1, L2, and L3 also extend parallel to one another and the floor surface.

The joint member 149 is rotatably connected to a support member 190 and thereby defines an axis of rotation A3 that extends parallel to the crank axis A1. An "effective length" of the variable length segment 140 is defined between the axis A3 and the axis A2. The joint member 149 may be said to define a connection point, and the junctures associated with the joint member 149 may be collectively described as a universal joint. The support member 190 is rigidly secured to a bracket 191 or 191' on a respective stanchion 119 or 119'.

Rotation of the crank 120 about the axis A1 causes the variable length segment 140 to pivot about the axis A3. In other words, the variable length segment 140 is constrained to move in reciprocating fashion relative to the connection point and also varies in length to accommodate radial movement of the axis A2 relative to the axis A3.

The support member 190 is a linear actuator having a cylinder or base portion 192 and a rod or movable portion 194. The base portion 192 is rigidly secured to the bracket 191 or 191', and the movable portion 194 is movable in a straight line relative thereto. A distal end of the movable portion 194 is rotatably connected to the joint member 149 and cooperates therewith to define the axis A3. The actuator 190 is operable to move the axis A3 relative to the axis A1.

On the embodiment 101, a separate support member 190 is disposed on each side of the stanchion 119 and connected to a respective joint member 149. In the embodiment 102, on the other hand, a single support member 190 is secured to the stanchion 119' and rotatably connected to both joint members 149. In all other respects, the two machines 101 and 102 are identical, and they generate identical paths of exercise motion.

Each foot supporting member 150 is rotatably interconnected between a respective fixed length segment 130 and a respective rocker link 160. Each foot supporting member 150 has an intermediate portion or platform 155 which is sized and configured to support a foot of a standing person and move together with the foot during exercise. In this regard, each foot supporting member 150 may be described as a force receiving means and/or a leg driven member. The rearward portion 153 of each foot supporting member 150 rotates about an axis A4 relative to the lower end 135 of a respective fixed length member 130. An opposite, forward portion 156 of each foot supporting member 150 is rotatably connected to a lower end 165 of a respective rocker link 160 and thereby defines an axis of rotation A5.

An intermediate portion 167 of each rocker link 160 is rotatably connected to the forward stanchion 117. In particular, a sleeve 106 is slidably mounted on the stanchion 117, and the rocker link 160 is rotatably connected to the sleeve 106. The sleeve 106 is secured in place relative to the stanchion 117 by means of a spring-loaded knob 107 (for reasons explained below). The result of this arrangement is that each foot supporting member 150 pivots relative to a respective rocker link 160 about an axis A5 which in turn, pivots relative to the frame about an axis A6. Those skilled in the art will recognize that the rocker link 160 could be connected directly to the stanchion 117 and/or could terminate immediately beyond the,axis A6 without departing from the scope of the present invention.

Each rocker link 160 may be described as being rotatably interconnected between a respective foot supporting member 150 and the frame and/or as a means for constraining the forward end 156 of the foot supporting member 150 to move in reciprocating fashion relative to the frame. An opposite, upper end 166 of each rocker link 160 is sized and configured for grasping by a person standing on the foot supports 155. In this regard, each rocker link 160 may be described as a force receiving means and/or an arm driven member.

To use either apparatus 101 or 102, a person stands with a respective foot on each of the foot supports 155 and a respective hand on each of the handles 166. As the person begins moving his arms and/or legs, the linkage assembly constrains the person's feet to move through elliptical paths and the person's hands to move through arcuate paths, while the cranks 120 rotate relative to the frame. As an alternative to this "total body" exercise, the person may wish to simply balance during leg exercise and/or steady himself relative to a stationary abdominal support and/or hand-holds rigidly secured to the frame.

Figure 2:
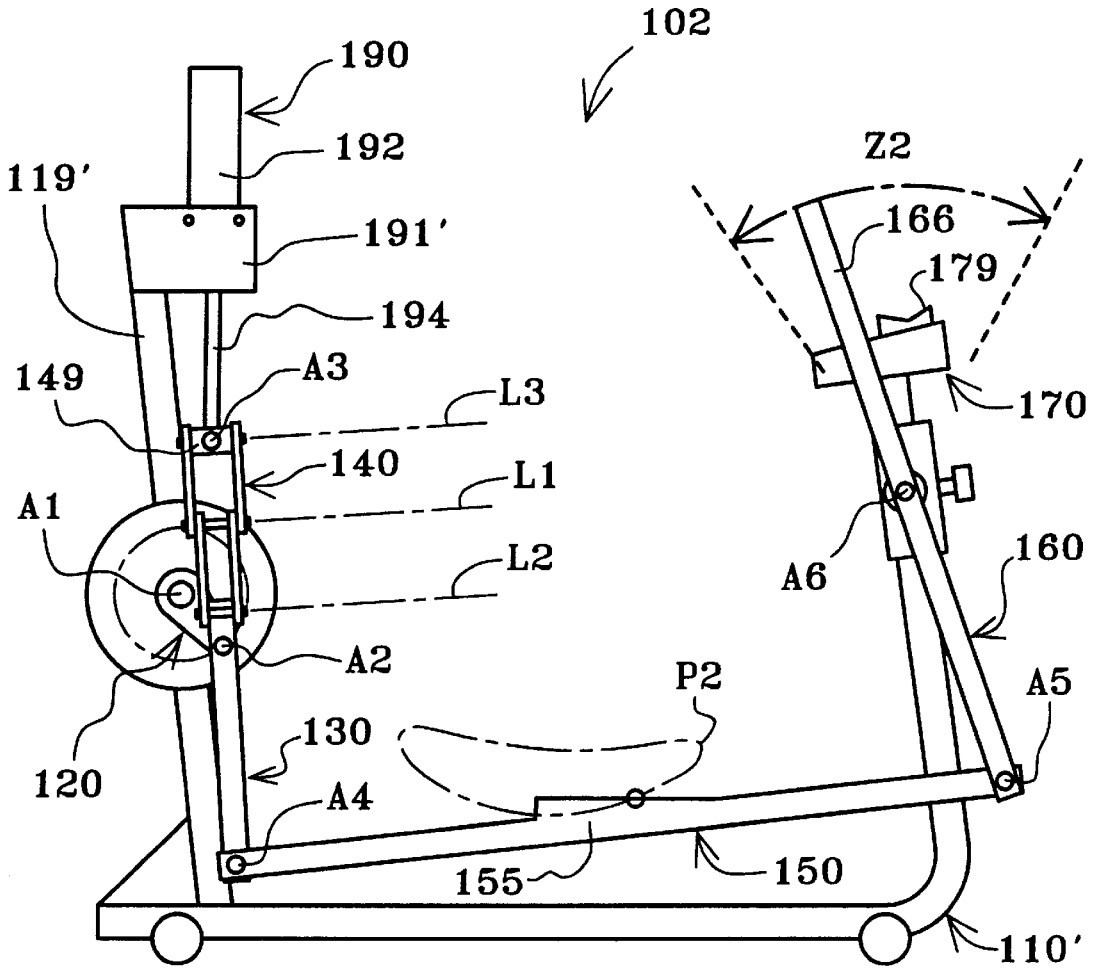
FIG. 2 is a side view of a similar exercise apparatus constructed according to the principles of the present invention.

When either machine 101 or 102 is configured as shown in FIG. 1 (with the movable member(s) 194 relatively retracted), the foot platforms 155 move through generally elliptical paths P1, and the handles 166 move through arcuate paths Z1. When either machine 101 or 102 is configured as shown in FIG. 2 (with the movable member(s) 194 relatively extended), the foot platforms 155 move through generally elliptical paths P2, and the handles 166 move through arcuate paths Z2. As suggested by a comparison between FIGS. 1 and 2, movement of the axis A3 downward and closer to the axis A1 causes an increase in the length of the exercise strokes (as measured generally parallel to the floor surface).

Adjustments to the distance between the axes A3 and A1 may be effected in several ways. In the embodiments 101 and 102, for example, a user interface device 170 is mounted on top of the stanchion 117, and an input device 179 is provided on the interface 170, within reach of a person standing on the foot platforms 155. The person may make the exercise strokes longer or shorter (as measured fore to aft) simply by pushing the button or switch 179. Those skilled in the art will recognize that the depicted switch 179 could be replaced by other suitable means, including a knob, for example, which not only would rotate to make adjustments but also would cooperate with indicia on the device 170 to indicate the current level of adjustment or length of stroke.

A person may change the inclination of the elliptical paths by repositioning the sleeve 106 relative to the stanchion 117. In particular, a pin or shaft on the spring-loaded knob 107 inserts through a hole in the sleeve 106 and any of several holes in the stanchion 117 to retain the former in place along the latter. In order to obtain a less demanding exercise motion, for example, a person pulls the pin on the spring-loaded knob 107 out of engagement with the stanchion 117 and allows the sleeve 106 to slide downward until the pin snaps into engagement with a relatively lower hole in the stanchion 117.

Figure 3:
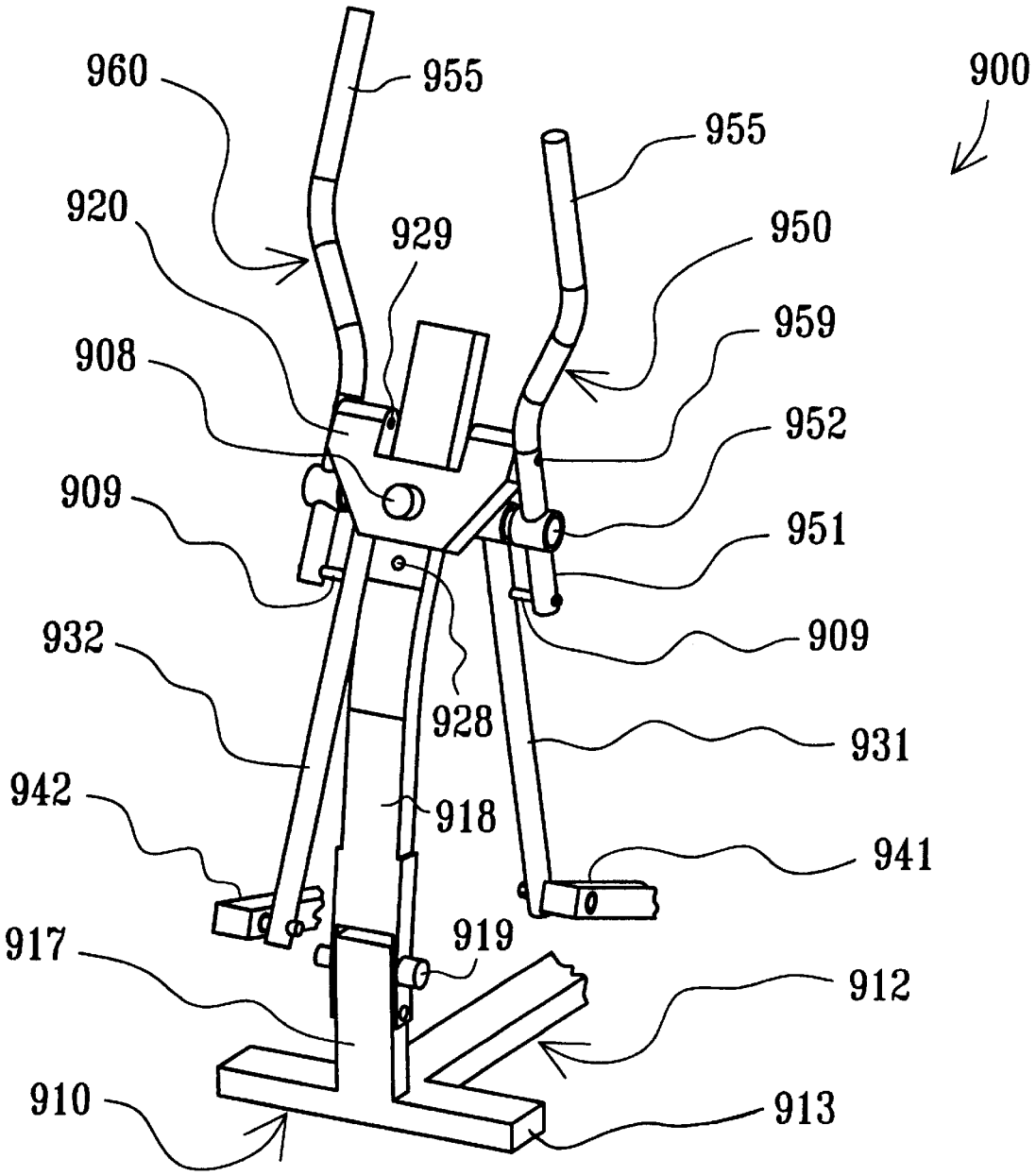
FIG. 3 is a perspective view of a handle assembly suitable for use on various embodiments of the present invention.

Those skilled in the art will recognize that the present invention is not limited to the construction specifics of the embodiments 101 and 102. Among other things, the spring-loaded knob 107 could be replaced by a motorized inclination adjusting means which is operable by means of another input device on the user interface device 170. Moreover, the actuator 190 and/or the inclination adjusting means could be controlled by a program stored within the device 170 or by signals received from an external source, such as a VCR tape or interactive sensors which respond to user applied force and/or movement. Alternatively, the actuator 190 could replaced by a manually operated stroke adjustment means. Either of the machines 101 or 102 could be further modified to include the innovative handle assembly designated as 900 in FIG. 3. The assembly 900 is shown relative to a frame 910 which includes a base 912 that is supported by transverse supports (one of which is shown as 913). A stanchion or upright 917 extends upward from the base 912 proximate the front end of the frame 910. A post 918 is pivotally mounted on the upright 917 and selectively secured in a generally vertical orientation by means of a ball detent pin 919. The pin 919 may be removed in order to pivot the post 918 to a collapsed or storage position relative to the frame 910.

Another frame member or yoke 920 is slidably mounted on the post 918, between an upper distal end and a pair of outwardly extending shoulders near the lower, pivoting end. Like on the embodiments 101 and 102, a spring-loaded pin 908 (or other suitable fastener) extends through the frame member 920 and into engagement with any of several holes 928 in the post 918 to selectively lock the frame member 920 at one of a plurality of positions along the post 918 (and above the floor surface beneath the apparatus 900).

Left and right vertical members or rocker links 931 and 932 have upper ends which are rotatably mounted to opposite sides of a shaft 952 on the frame member 920. Opposite, lower ends of the links 931 and 932 are rotatably connected to forward ends of respective foot supporting members 941 and 942 (which are similar to the foot supporting members 150). As a result of this arrangement, the inclination of the path traveled by the foot supporting members 941 and 942 is partly a function of the height of the frame member 920 above the floor surface. In other words, the difficulty of exercise can be increased simply by locking the frame member 920 in a relatively higher position on the post 918.

Left and right handle members 950 and 960 are also rotatably connected to opposite ends of the shaft 952 on the frame member 920 and thus, share a common pivot axis with the links 931 and 932. The handle members 950 and 960 include upper, distal portions 955 which are sized and configured for grasping by a person standing on the foot supporting members 941 and 942. A hole is formed through each handle member 950 and 960, proximate its lower end 951 (and beneath the pivot axis), and a corresponding hole is formed through each link 931 and 932 at an equal radial distance away from the pivot axis.

Pins 909 are inserted through the aligned holes to interconnect respective links 931 and 932 and handle members 950 and 960 and thereby constrain each pinned combination to pivot as a unit about the pivot axis. In this particular configuration, the pins 909 may be said to be selectively interconnected between respective handle members 950 and 960 and links 931 and 932, and/or to provide a means for selectively linking respective arm driven members 950 and 960 and leg driven members 931 and 932. Moreover, the pins 909 may be seen to cooperate with the links 931 and 942 to provide a means for selectively linking the handle members 950 and 960 and respective foot supporting members 941 and 942.

Another hole 959 is formed through each of the handle members 950 and 960, above the pivot axis, and corresponding holes 929 are formed in the frame member 920 at an equal distance above the pivot axis. The same pins 909 may alternatively be inserted through the aligned holes 959 and 929 to interconnect the handle members 950 and 960 and the frame member 920 and thereby lock the former in place relative to the latter. In this configuration, the pins 909 may be seen to provide a means for selectively locking the handle members 950 and 960 to the frame 910 (without affecting movement of the links 931 and 932 relative to the frame 910). In the absence of any such pin connections, the handle members 950 and 960 and the foot supporting members 941 and 942 are free to pivot relative to the frame 910 and one another.

The depicted means for accommodating the varying distance between the axes A2 and A3 may be replaced by other suitable means, as well. For example, each "variable length" member could be a rigid bar having a fixed length but movably connected to the "fixed length" member. Such an arrangement is shown on the apparatus designated as 400 in FIGS. 4–7.

The apparatus 400 includes a frame 410 having a base which is designed to rest upon a floor surface. A forward stanchion 417 extends upward from the base proximate the front end 411 of the frame 410, and a rearward stanchion 419 extends upward from the base proximate the rear end 412 of the frame 410. A user interface 406 is mounted on top of the forward stanchion 417 and provides input devices or slides 407 and 408 (for reasons explained below). The input devices 407 and 408 are depicted with discrete shapes to make them readily distinguishable from one another for illustration purposes.

On each side of the apparatus 400, a crank 420 is mounted on the stanchion 419 and rotates relative thereto about an axis B1. Those skilled in the art will recognize that all sorts of known resistance devices and/or inertia altering mechanisms may be connected to the cranks 420 without departing from the scope of the present invention. For example, the cranks 420 may be connected to a "stepped-up" flywheel and drag strap arrangement of the type well known in the art and thus, not depicted in FIGS. 4–7.

On each side of the apparatus 400, a first link or rigid member 430 has a first portion connected to a respective crank 420 and rotatable relative thereto about a respective axis B2. A second link or rigid member 440 is connected to the first link 430 and slides relative thereto in a direction perpendicular to the axes B1 and B2. A distal end of the second link 440 is connected to an end of a first support 470 and rotates relative thereto about an axis B3. An opposite end of the first support 470 is connected to an intermediate portion of a second support 480 and selectively rotates relative thereto about an axis B7.

A first linear actuator 497 is rotatably interconnected between the stanchion 419 and an intermediate portion of the first support 470. The actuator 497 and the support 470 cooperate to define a rotational axis B8, and the actuator 497 and the stanchion 419 cooperate to define a rotational axis B9. A first end of the second support 480 is connected to the stanchion 419 and selectively rotates relative thereto about the same axis B9. A second linear actuator 498 is rotatably interconnected between an opposite end of the second support 480 and a rearward portion of the base. The actuator 498 and the second support 480 cooperate to define a rotational axis B10, and the actuator 498 and the base cooperate to define a rotational axis B11.

In the absence of a control signal, the actuators 497 and 498 function as rigid supports and cooperate with the frame 410 and the supports 470 and 480 to maintain the link axis B3 in a fixed position relative to the crank axis B1. The actuator 497 is connected to the input device 407 in such a manner that rearward sliding of the device 407 results in a decrease in the distance between the axes B10 and B9. The actuator 498 is connected to the input device 408 in such a manner that rearward sliding of the device 408 results in a decrease in the distance between the axes B10 and B11. The significance of these adjustments are discussed in greater detail below. The input devices 407 and 408 cooperate with indicia on the interface 406 to indicate the status of the respective actuators 497 and 498. Those skilled in the art will recognize that other input devices, which may or may not indicate the level of adjustment, may be substituted for those shown.

On each side of the apparatus 400, a foot supporting member 450 is rotatably interconnected between a lower end of a respective first link 430 and a lower end of a respective rocker link 460. The rearward end of the foot supporting member 450 cooperates with a respective first link 430 to define a rotational axis B4, and the forward end of each foot supporting member 450 cooperates with a respective rocker link 460 to define a rotational axis B5. An intermediate portion 455 of each foot supporting member 450 is sized and configured to support a foot of a standing person.

An intermediate portion of each rocker link 460 is connected to the stanchion 417 and rotates relative thereto about an axis B6. An upper end of each rocker link 460 is sized and configured for grasping by a person standing on the foot supporting members 450. Those skilled in the art will recognize that the apparatus 400 may be modified to include the tri-modal arm exercise assembly 900 shown and described with reference to FIG. 3.

Figure 4:
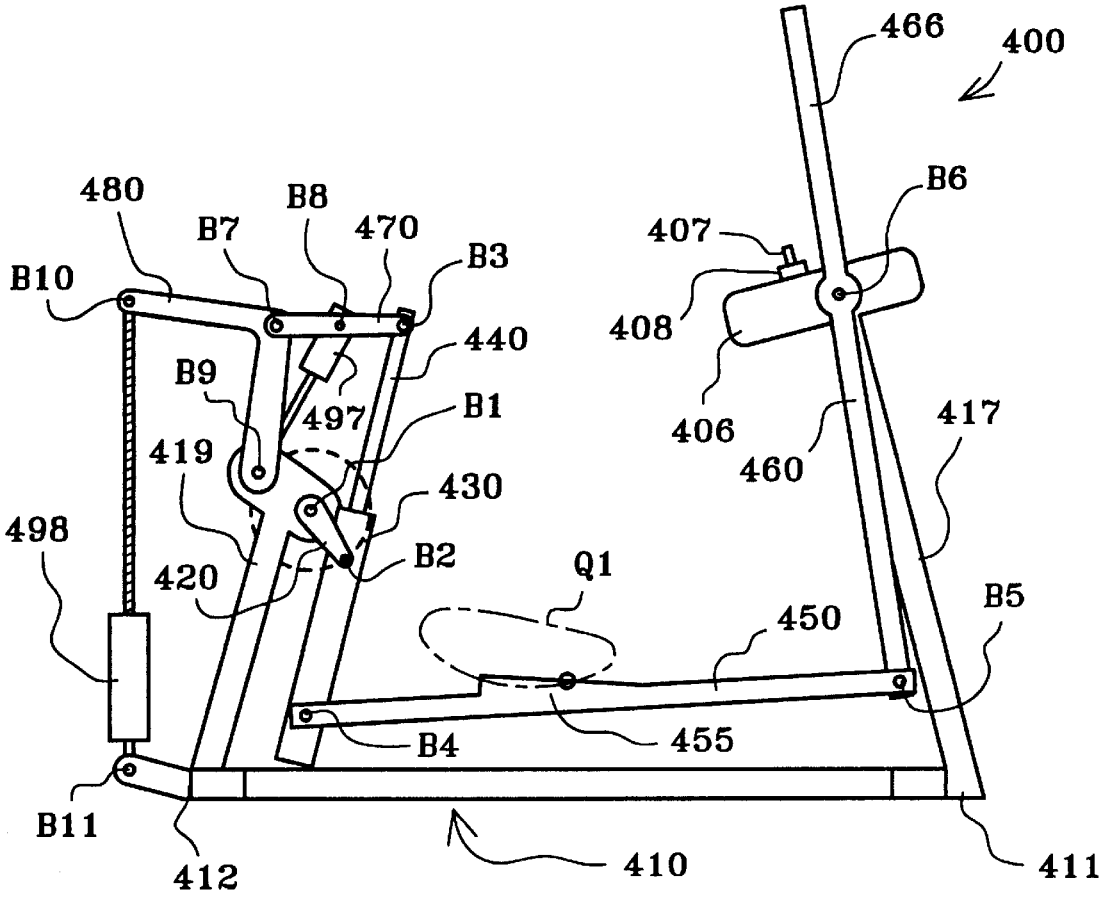
FIG. 4 is a side view of another exercise apparatus constructed according to the principles of the present invention.
Figure 5:
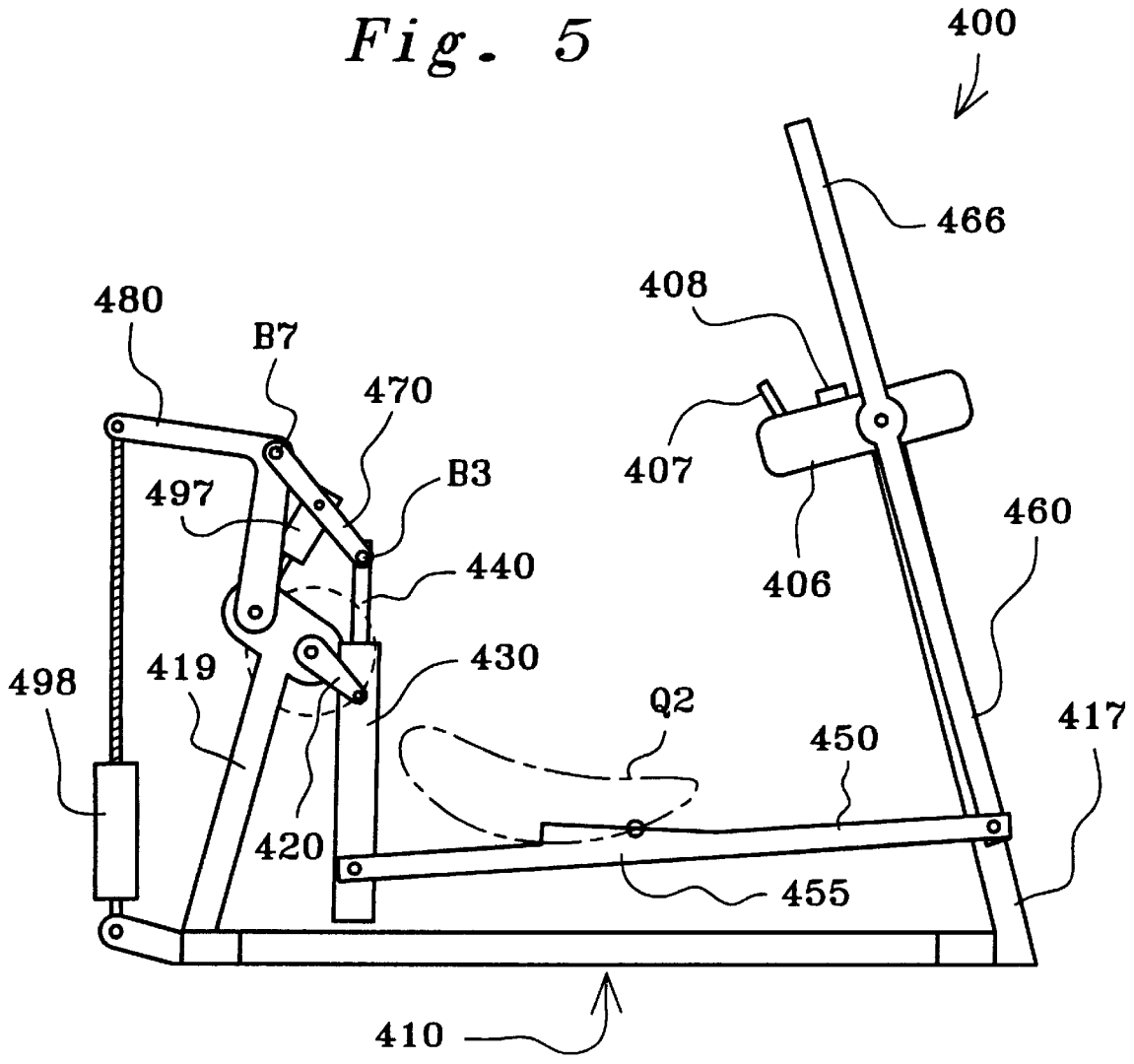
FIG. 5 is a side view of the exercise apparatus of FIG. 4, shown in a second configuration.

When the apparatus 400 is configured as shown in FIG. 4, the intermediate portion 455 of each foot supporting member 450 is constrained to move through the depicted path Q1. When the apparatus 400 is configured as shown in FIG. 5 (the input device 407 having been moved rearward to decrease the distance between the axes B8 and B9), the intermediate portion 455 of each foot supporting member 450 is constrained to move through the depicted path Q2. In other words, movement of the link axis B3 generally downward and toward the crank axis B1 primarily results in a longer path of foot travel.

Figure 6:
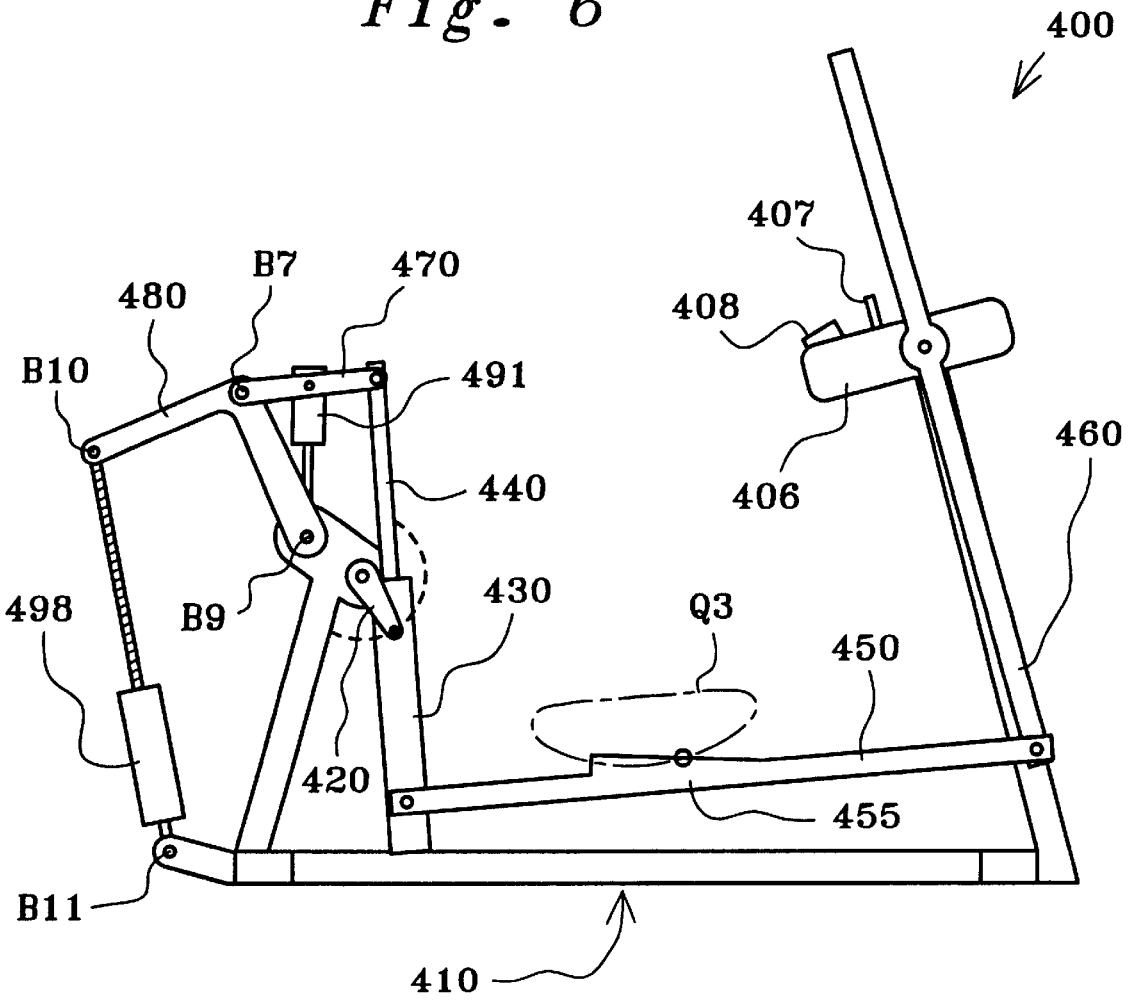
FIG. 6 is a side view of the exercise apparatus of Figure 4, shown in a third configuration.
Figure 7:
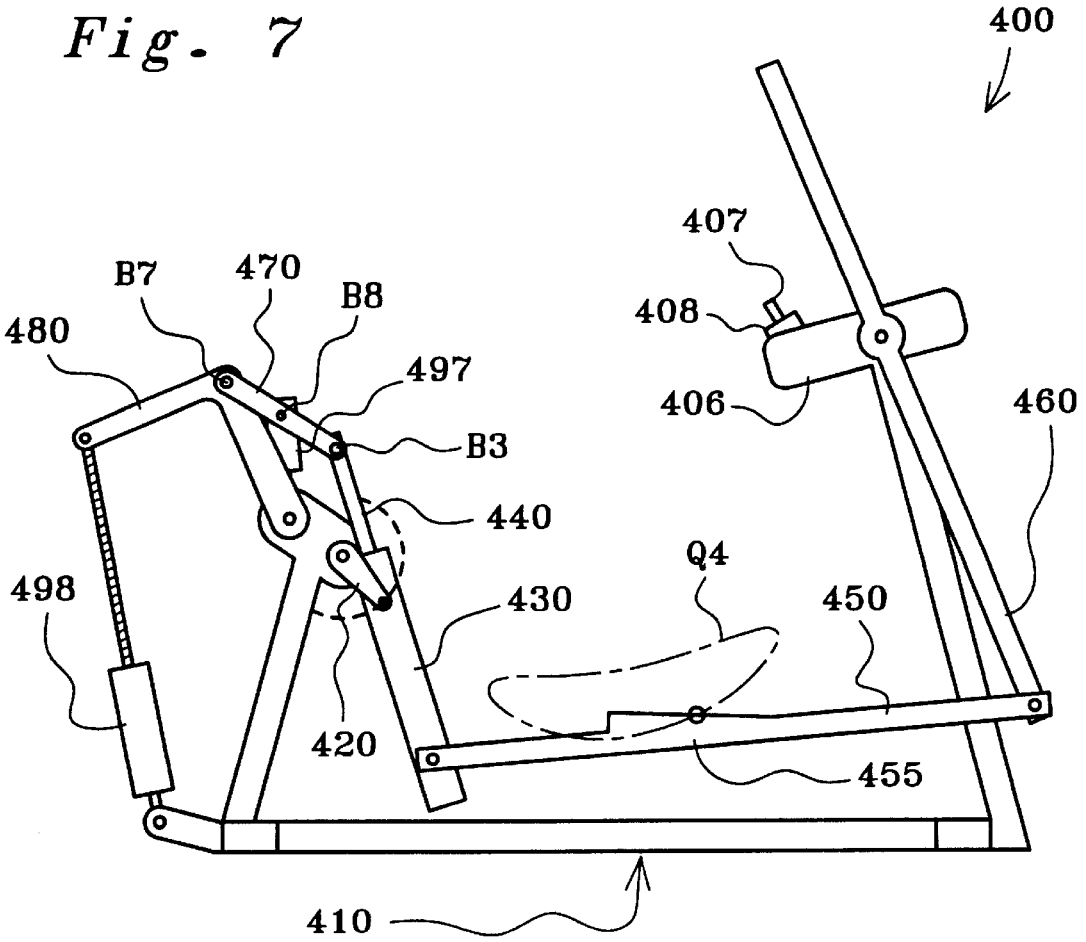
FIG. 7 is a side view of the exercise apparatus of FIG. 4, shown in a fourth configuration.

When the apparatus 400 is configured as shown in FIG. 7 (the input device 408 having been moved rearward to decrease the distance between the axes B10 and B11), the intermediate portion 455 of each foot supporting member 450 is constrained to move through the depicted path Q4. When the apparatus 400 is configured as shown in FIG. 6 (the input device 407 having been returned forward to increase the distance between the axes B8 and B9), the intermediate portion 455 of each foot supporting member 450 is constrained to move through the depicted path Q3. In other words, movement of the link axis B3 generally rearward primarily results in a more upwardly inclined path of foot travel.

An advantage of the apparatus 400 is that separate means are provided for adjusting the length of the exercise stroke and for adjusting the inclination of the exercise stroke. Moreover, both adjustment means are accessible to a person standing on the foot supporting members 450 and both are operable during exercise on the apparatus 400.

Figure 9:
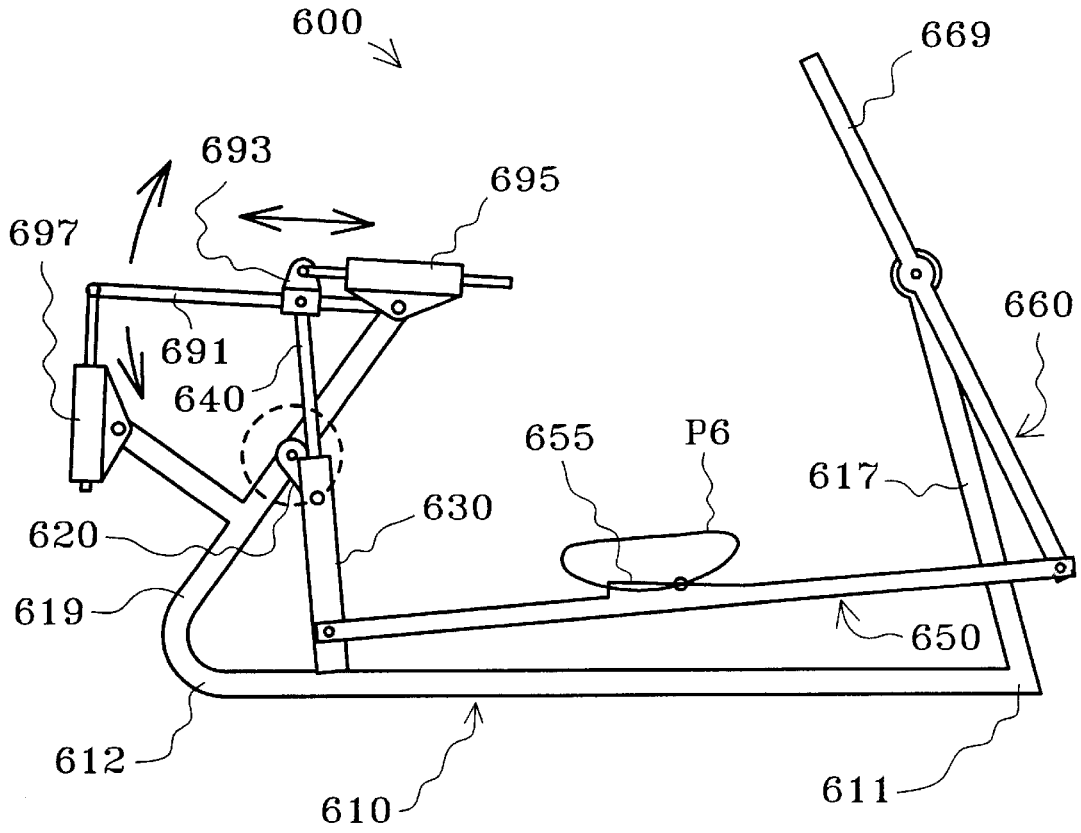
FIG. 9 is a side view of another exercise apparatus constructed according to the principles of the present invention.

Another embodiment with "telescoping" connector links is designated as 600 in FIG. 9. Like the previous embodiment 400, the apparatus 600 has a frame 610 with a base designed to rest upon a floor surface. A forward stanchion 617 extends upward from the base proximate its forward end 611, and a rearward stanchion 619 extends upward from the base proximate its rearward end 612.

Left and right cranks 620 are rotatably mounted on the stanchion 619 and rotate about a common crank axis. A cylinder portion 630 of each connector link has an upper portion rotatably connected to a respective crank 620, and a lower portion rotatably connected to a rearward end of a respective foot supporting member 650. A forward end of each foot supporting member 650 is rotatably connected to a lower end of a respective rocker link 660, and an intermediate portion 655 of each foot supporting member 650 is sized and configured to support a respective foot of a standing person. An intermediate portion of each rocker link 660 is rotatably mounted on the stanchion 617, and an upper distal end 669 of each rocker link 660 is sized and configured for grasping.

A rod portion 640 of each connector link has a lower portion which is movably connected to a respective cylinder portion 630, and, contrary to the previous embodiment 400, an upper end which is rotatably connected to a respective bushing 693. A bar 691 has a forward end which is rotatably connected to the stanchion 619, and the bushing 693 is slidably mounted on the bar 691. A first actuator 695 is operatively interconnected between the stanchion 619 and the bushing 693 and is operable to selectively move the latter back and forth along the former. A second actuator 697 is operatively interconnected between the stanchion 619 and the rearward end of the bar 691 and is operable to selectively pivot the latter upward and downward relative to the former.

When the apparatus 600 is configured as shown in FIG. 9, the left and right foot supports 655 moved through the generally elliptical paths designated as P6. Rearward movement of the bushing 693 relative to the bar 691 primarily results in a relatively more "uphill" orientation of the foot paths. Downward pivoting of the bar 691 primarily results in a relatively longer stride length for the foot paths.

Figure 10:
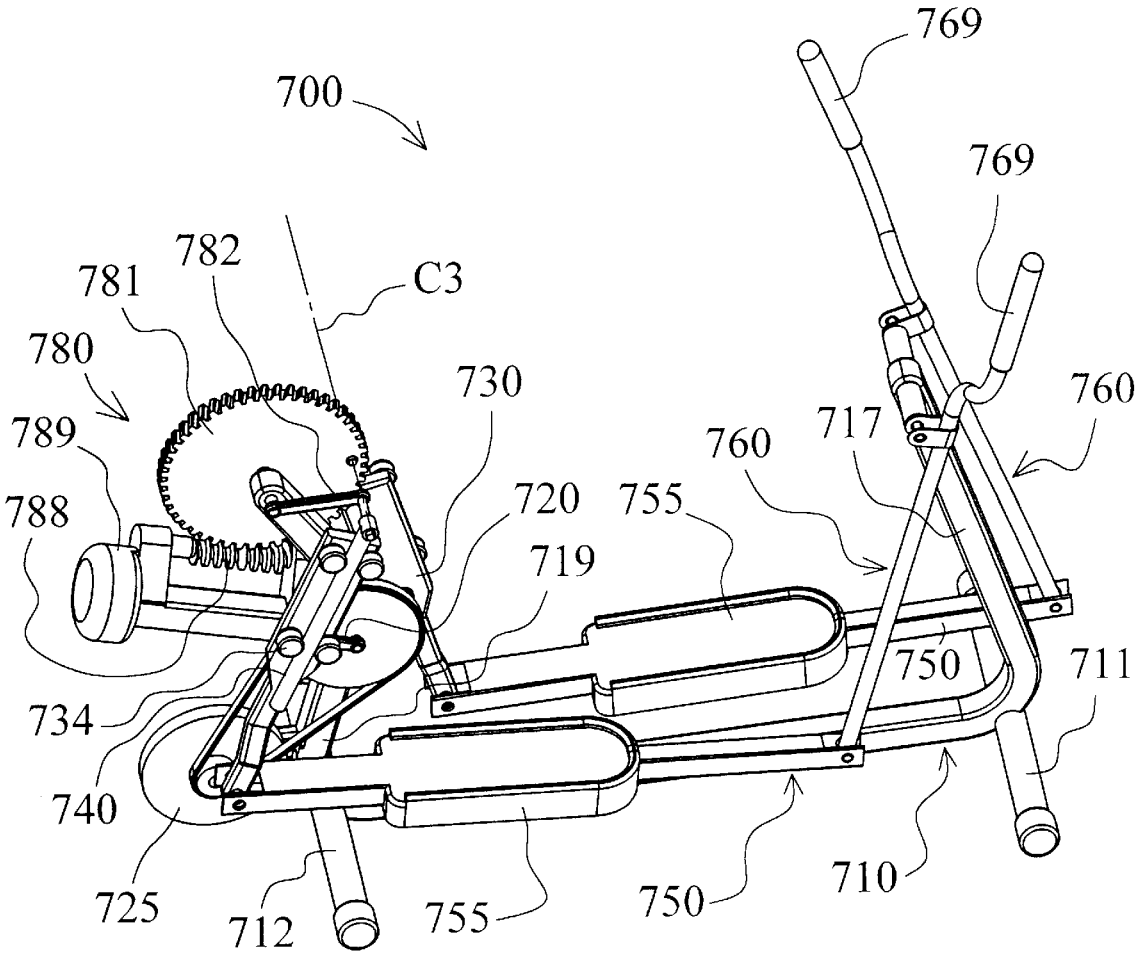
FIG. 10 is a perspective view of yet another embodiment of the present invention.

Another variation of the present invention is designated as 700 in FIG. 10. The apparatus 700 has a frame 710 with a base designed to rest upon a floor surface. A forward stanchion 717 extends upward from the base proximate its forward end 711, and a rearward stanchion 719 extends upward from the base proximate its rearward end 712.

Left and right cranks 720 are rotatably mounted on the stanchion 719 and rotate about a common crank axis. The cranks 720 are connected to a "stepped-up" flywheel 725 by means of a common belt and pulley arrangement. As with other embodiments described herein, the flywheel 725 may be supplemented with or replaced by other known inertia altering mechanisms.

A first portion 730 of each connector link has an upper portion rotatably connected to a respective crank 720, and a lower portion rotatably connected to a rearward end of a respective foot supporting member 750. A forward end of each foot supporting member 750 is rotatably connected to a lower end of a respective rocker link 760, and an intermediate portion 755 of each foot supporting member 750 is sized and configured to support a respective foot of a standing person. An intermediate portion of each rocker link 760 is rotatably mounted on the stanchion 717, and an upper distal end 769 of each rocker link 760 is sized and configured for grasping by a person standing on the foot supporting members 750.

Opposing rollers 734 are rotatably mounted on the upper portion of each connector link portion 730, and a second, rod portion 740 of each connector link is movably supported between the rollers 734 on a respective first portion 730. An upper end of each rod portion 740 is rotatably connected to a respective adjustment member, one of which is an arm 782, and the other of which is a rotary gear 781. The two adjustment members 781 and 782 rotate about a common axis relative to the stanchion 719.

The adjustment members 781 and 782 cooperate with their respective connector links to define a common pivot axis C3, which corresponds to the axis B3 on the embodiment 400 described above. When the apparatus 700 is configured as shown in FIG. 10, rotation of the cranks 720 about the crank axis is linked to pivoting of the connector links (including portions 730 and 740) about the pivot axis C3, and generally elliptical movement of the left and right foot supports 755.

The adjustment members 781 and 782 cooperate with a motorized worm gear 788 to provide a means 780 for varying the position of the pivot axis C3 relative to the crank axis. More specifically, a motor 789 selectively rotates the worm gear 788 to change the orientation of the rotary gear 781 and the arm 782 and hence, the position of the pivot axis C3, relative to the frame 710. In general, rotation of the gear 781 in a first direction results in a relatively longer and more uphill foot path, and rotation of the gear 782 in a second, opposite direction results in a relatively shorter and less uphill foot path. Several possible foot path configurations are shown in FIGS. 11 and 11K–11O and described below with reference to another embodiment designated as 800.

The exercise apparatus 800 has a frame 810 with a base designed to rest upon a floor surface. A forward stanchion 817 extends upward from the base proximate its forward end 811, and a rearward stanchion 819 extends upward from the base proximate its rearward end 812.

Left and right cranks 820 are rotatably mounted on the stanchion 819 and rotate about a common crank axis. Cylinder portions 830 of left and right connector links have upper portions rotatably connected to respective cranks 820, and lower portions rotatably connected to rearward ends of respective foot supporting members 850. Forward ends of the foot supporting members 850 are rotatably connected to lower ends of respective rocker links 860, and intermediate portions 855 of the foot supporting members 850 are sized and configured to support respective feet of a standing person. Intermediate portions of the rocker links 860 are rotatably mounted on the stanchion 817, and upper distal ends 869 of the rocker links 860 are sized and configured for grasping by a person standing on the foot supporting members 850.

Like on the previous embodiment 700, rod portions 840 of the connector links have lower portions which are movably connected to respective cylinder portions 830, and upper ends which are rotatably connected to respective adjustment members 884. The adjustment members 884 rotate about a common axis G relative to the stanchion 819. The adjustment members 884 cooperate with their respective connector links to define a common pivot axis designated as J in FIG. 11, which corresponds to the axis C3 on the previous embodiment 700. When the apparatus 800 is configured as shown in FIG. 11, rotation of the cranks 820 about the crank axis is linked to pivoting of the connector links (including portions 830 and 840) about the pivot axis J, and movement of the left and right foot supports 855 through the generally elliptical paths PJ.

The adjustment members 884 cooperate with a motorized pinion gear 886 to provide a means 880 for varying the position of the pivot axis relative to the crank axis. More specifically, a motor (not shown or manually operated knob) selectively rotates the pinion gear 886 to change the orientation of the adjustment members 884 and hence, the position of the connector link pivot axis, relative to the frame 810. When the pivot axis occupies the position designated as K in FIG. 11, a central portion of each foot support 855 moves through the path designated as PK in FIG. 11K. The same may be said for the pivot axis locations designated as L–O in FIG. 11 and respective paths designated as PL–PO in FIGS. 11L–11O.

Figure 12:
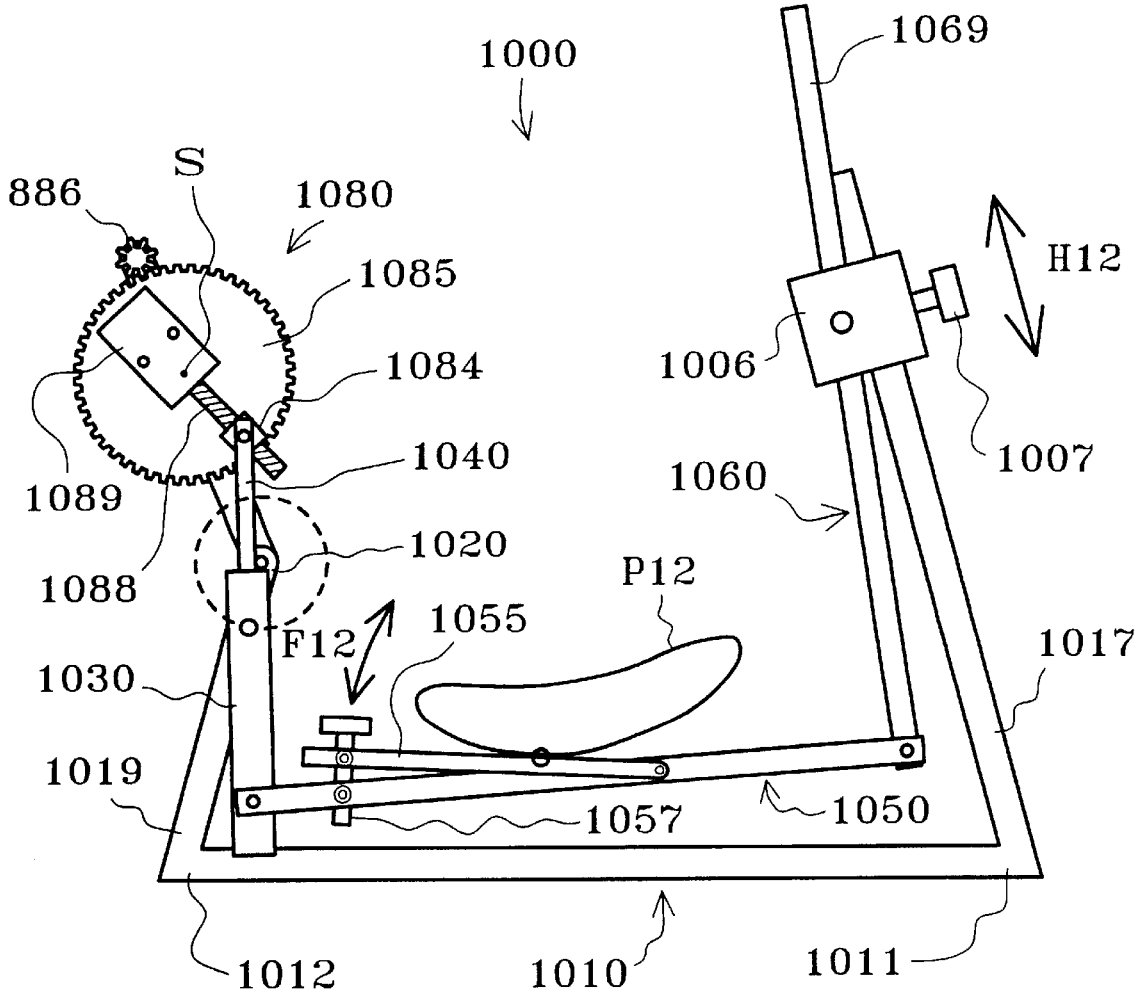
FIG. 12 is a side view of another exercise apparatus constructed according to the principles of the present invention.

Another exercise apparatus constructed according to the principles of the present invention is designated as 1000 in FIG. 12. The apparatus 1000 has a frame 1010 which includes a base designed to rest upon a floor surface. A forward stanchion 1017 extends upward from the base proximate its forward end 1011, and a rearward stanchion 1019 extends upward from the base proximate its rearward end 1012.

Left and right cranks 1020 are rotatably mounted on the stanchion 1019 and rotate about a common crank axis. Cylinder portions 1030 of left and right connector links have upper portions rotatably connected to respective cranks 1020, and lower portions rotatably connected to rearward end of respective foot supporting members 1050. Forward ends of the foot supporting members 1050 are rotatably connected to lower ends of respective rocker links 1060. An intermediate portion of each rocker link 1060 is rotatably connected to the forward stanchion 1017. In particular, the rocker link 1060 is rotatably connected to a sleeve 1006 which is slidably mounted on the stanchion 1017 (as suggested by the arrow designated as H12 in FIG. 12). The sleeve 1006 is secured in place relative to the stanchion 1017 by means of a spring-loaded knob 1007. An upper distal end 1069 of each rocker link 1060 is sized and configured for grasping by a person standing on foot supports 1055.

Left and right foot supports 1055 have forward ends which are rotatably connected to intermediate portions of respective foot supporting members 1050, and rearward ends which are movably connected to respective foot supporting members 1050 by means of respective adjustment screws 1057. Each foot support 1055 is sized and configured to support a respective foot of a standing person. As suggested by the arrow designated as F12 in FIG. 12, each screw 1057 is operable to alter the inclination of a respective foot support 1055 relative to its respective foot supporting member 1050 and the underlying floor surface.

Left and right rod portions 1040 of the connector links have lower portions which are movably connected to respective cylinder portions 1030, and upper ends which are movably connected to the stanchion 1019 by means of an adjustment assembly 1080. In particular, each rod portion 1040 is rotatably connected to a respective nut 1084 which is threaded onto a respective screw 1088. Each screw 1088 is selectively rotated by a motor 1089 which is rigidly mounted on a respective side of a single gear 1085. The gear 1085 is rotatably mounted on the stanchion 1019 (about an axis S) and selectively rotated by a pinion gear 886 like that on the previous embodiment 800.

The nuts 1084 cooperate with their respective connector links 1040 to define a common pivot axis which corresponds to the axis J on the previous embodiment 800. When the apparatus 1000 is configured as shown in FIG. 12, rotation of the cranks 1020 about the crank axis is linked to pivoting of the connector links about the common pivot axis, and movement of the left and right foot supports 1055 through the generally elliptical paths designated as P12 in FIG. 12.

The paths of foot travel may be adjusted in a number of ways. For example, the motor(s) 1089 are operable to move the nuts 1084 (and the common pivot axis) radially relative to the axis S, and/or the pinion gear 886 is operable to move the nuts 1084 (and the common pivot axis) circumferentially relative to the axis S. In general, horizontal movement of the pivot axis primarily affects the foot path inclination, and vertical movement of the pivot axis affects the stride length. Also, the sleeve 1006 is movable along the stanchion 1017 to adjust the inclination of the foot paths, and/or the foot supporting members 1055 are adjustable relative to the foot supporting members 1050 to adjust the orientations of the feet for any given path of travel.

The connector links on the foregoing embodiments are configured to accommodate changes in distance between the crank axis (A1 or B1 on respective embodiments 101 and 400, for example) and the pivot axis (A3 or B3) during exercise motion and during adjustments to the configuration of the apparatus (e.g. from J to any of K–O on the embodiment 800, for example). On the embodiments 101 and 102, the radial length of the upper member 140 changes in order to make this accommodation. On the embodiments 400 and 800, the upper member 440 or 840 moves in telescoping fashion relative to the lower member 430 or 830 in order to make this accommodation.

Another suitable way to accommodate this variable distance and/or restrain rotation movement of the connector links during rotation of the cranks is described with reference to the embodiment designated as 1100 in FIG. 13. Generally speaking, this embodiment 1100 provides variable distance accommodation (or facilitates relative movement) at the point of connection between the frame and each connector link. In particular, a rigid, unitary connector link 1130 has an elongate slot 1140 or race formed in one end thereof. A bearing member 1144 (such as a roller or low friction post) is mounted on the frame 1110 and bears against the walls of the slot 1140 during exercise motion. The rotational axis of the roller 1144 defines the link axis and is selectively movable relative to the crank axis by means of at least one linear actuator interconnected between the roller 1144 and the frame 1110.

Like the apparatus 400, the embodiment 1100 includes a frame 1110 having a base which is designed to rest upon a floor surface. A forward stanchion 1117 extends upward from the base proximate the front end 1111 thereof, and a rearward stanchion 5 1119 extends upward from the base proximate the rear end 1112 thereof. A user interface 1106 is mounted on top of the forward stanchion 1117 and provides input devices or slides 1107 and 1108 (for reasons explained below). The input devices 1107 and 1108 are depicted with discrete shapes to make them readily distinguishable from one another for illustration purposes.

Left and right cranks 1120 are mounted on the stanchion 1119 and rotate relative thereto about an axis E1. Left and right connector links 1130 have first portions connected to respective cranks 420 and rotatable relative thereto about respective axes (one of which is designated as E2, and the other of which is diametrically opposed from axis E2). The connector links 1130 have second portions which are disposed generally opposite the first portions relative to the crank axis E1. Each second portion is provided with a respective slot 1140 which accommodates a respective roller 1144. Each roller 1144 is rotatably mounted on the frame 1110 and rotates relative thereto about a common axis E3. During rotation of the cranks 1120, the orientations of the connector links 1130 coincide with respective lines drawn between respective axes E2 and E3.

Each roller 1144 is rotatably mounted on a rearward end of a first common support 1170. An opposite, forward end of the first support 1170 is rotatably connected to a second common support 1180 and selectively rotates relative thereto about an axis E7. A first linear actuator 1197 is rotatably interconnected between the frame 1110 and an intermediate portion of the first support 1170. The actuator 1197 is operable to selectively rotate the first support 1170 about the axis E7.

A second portion of the second support 1180 is connected to the frame 1110 and selectively rotates relative thereto about an axis E8. A second linear actuator 1198 is rotatably interconnected between a third portion of the second support 1180 and the frame 1110. The actuator 1198 is operable to selectively rotate the first support 1180 about the axis E8. In the absence of a control signal, the actuators 1197 and 1198 function as rigid supports and cooperate with the frame 1110 and the supports 1170 and 1180 to maintain the link axis or connection point E3 in a fixed position relative to the crank axis E1.

The actuator 1197 is connected to the input device 1107 in such a manner that rearward sliding of the device 1107 results in downward pivoting of the support 1170. The actuator 1198 is connected to the input device 1108 in such a manner that rearward sliding of the device 1108 results in rearward pivoting of the axis E7. The significance of these adjustments is discussed in greater detail below. The input devices 1107 and 1108 cooperate with indicia on the interface 1106 to indicate the status of the respective actuators 1197 and 1198. Those skilled in the art will recognize that other input devices, which may or may not indicate the level of adjustment, may be substituted for those shown.

Left and right foot supporting members 1150 are rotatably interconnected between lower ends of respective first links 1130 and lower ends of respective rocker links 1160. The rearward ends of the foot supporting members 1150 cooperate with respective first links 1130 to define respective rotational axes E4, and the forward ends of the foot supporting members 1150 cooperate with respective rocker links 1160 to define respective rotational axes E5. An intermediate portion 1155 of each foot supporting member 1150 is sized and configured to support a respective foot of a standing person. An intermediate portion of each rocker link 1160 is connected to the stanchion 1117 and rotates relative thereto about an axis E6. An upper end of each rocker link 1160 is sized and configured for grasping by a person standing on the foot supporting members 1150.

Figure 13:
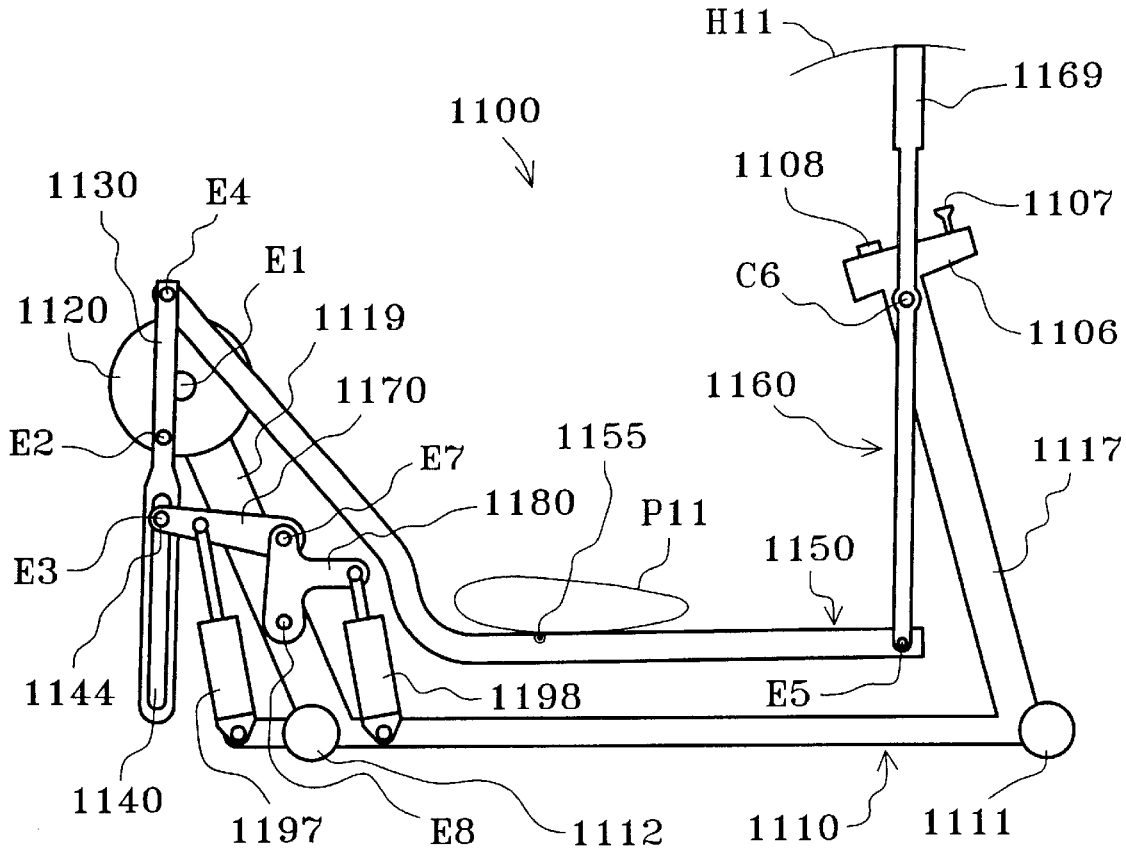
FIG. 13 is a side view of yet another embodiment of the present invention.

When the apparatus 1100 is configured as shown in FIG. 13, the intermediate portion 1155 of each foot supporting member 1150 is constrained to move through the depicted path P11. When the input device 1107 is moved rearward and the support 1170 pivots downward, the intermediate portion 1155 of each foot supporting member 1150 is constrained to move through a relatively longer path. When the input device 1108 is moved forward and the pivot axis E7 pivots rearward, the intermediate portion 1155 of each foot supporting member 1150 is constrained to move through a relatively more upwardly inclined path. In any case, the handles 1169 move through an arcuate path H11 (which will vary in length according to the adjustments made to the foot path).

Figure 14:
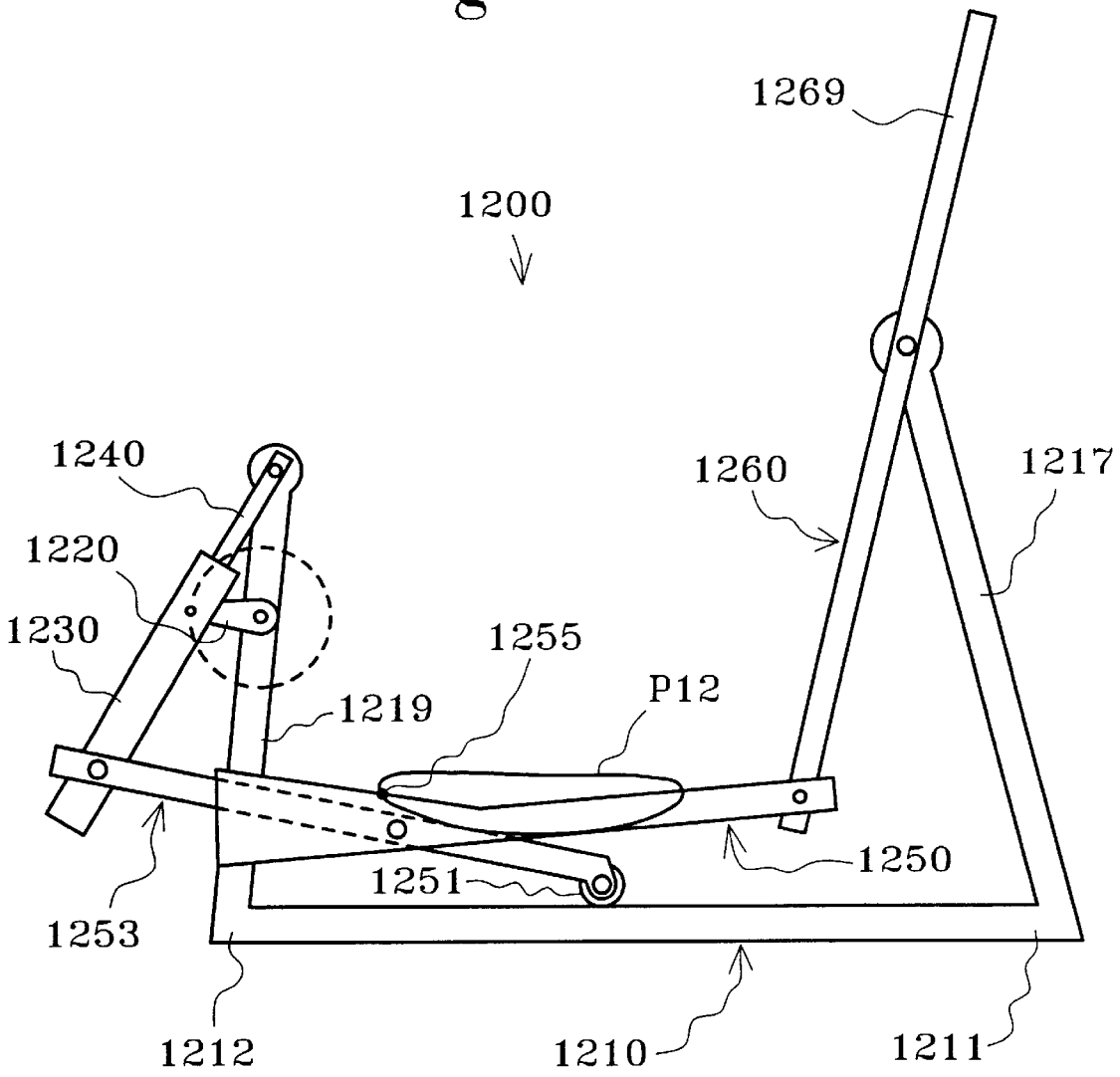
FIG. 14 is a side view of still another embodiment of the present invention.

The foregoing description sets forth only some of the many possible implementations of the present invention. For example, the depicted handlebar rocker links on any of the foregoing embodiments may be replaced by rollers mounted on the forward ends of the foot supporting links and rollable against a ramp or tracks mounted on the frame. Another alternative arrangement is shown in FIG. 14. The exercise apparatus 1200 has a frame 1210 with a base designed to rest upon a floor surface. A forward stanchion 1217 extends upward from the base proximate its forward end 1211, and a rearward stanchion 1219 extends upward from the base proximate its rearward end 1212.

Left and right cranks 1220 are rotatably mounted on the stanchion 1219 and rotate about a common crank axis. A cylinder portion 1230 of each connector link has an upper portion rotatably connected to a respective crank 1220, and a lower portion rotatably connected to a rearward end of a respective intermediate link 1253. A rod portion 12410 of each connector link has a lower portion which is movably connected to a respective cylinder portion 1230, and an upper end which is rotatably connected to an upper end of the stanchion 1219.

Rollers 1251 are rotatably mounted on forward ends of respective intermediate links 1253 and are free to roll across respective bearing surfaces on the frame 1210. Left and right foot supporting members 1250 have rearward portions which are rotatably connected to intermediate portions of respective intermediate links 1253. Left and right foot platforms 1255 are provided on respective foot supporting members 1250 to support a person's feet. Opposite, forward portions of the foot supporting members 1250 are rotatably connected to lower ends of respective rocker links 1260. An intermediate portion of each rocker link 1260 is rotatably mounted on the stanchion 1217, and an upper distal end 1269 of each rocker link 1260 is sized and configured for grasping by a person standing on the foot supporting members 1250. When the apparatus 1200 is configured as shown in FIG. 14, the left and right foot supports 1255 moved through the generally elliptical paths designated as P12.

Figure 8:
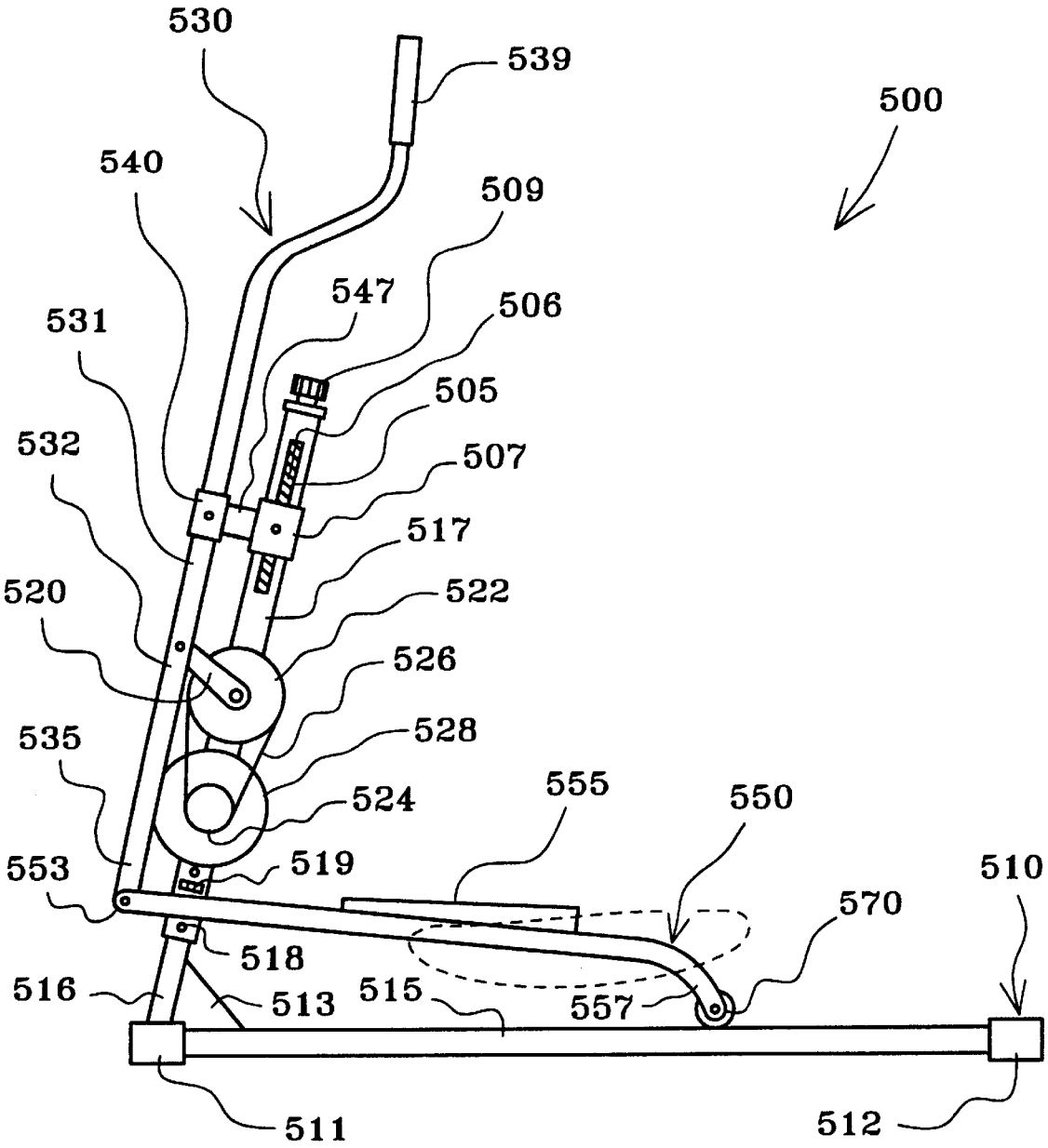
FIG. 8 is a side view of another embodiment of the present invention.

Still another embodiment of the present invention is designated as 500 in FIG. 8. The apparatus 500 includes a frame 510 which is designed to rest upon a floor surface. The frame 510 includes a forward transverse support 511, a rearward transverse support 512, and a pair of intermediate base members 515 extending therebetween. A post 516 extends upward from the forward support 511, and a reinforcing web or plate 513 is secured therebetween to enhance structural integrity. A tube 517 is mounted on the post 516 and selectively movable relative thereto in telescoping fashion. Any one of a series of holes 518 in the tube 517 aligns with a hole in the post 516 to receive a pin 519 or other fastener. The pin 519 inserts through the aligned holes to lock the tube 517 in place relative to the post 516.

Left and right cranks 520 are rotatably mounted on opposite sides of the tube 517 and rotate relative thereto about a common crank axis. The cranks 520 are one hundred and eighty degrees out of phase relative to one another, and only the left crank is shown in FIG. 8. A relatively large diameter pulley 522 rotates together with the cranks 520 about the crank axis and is connected to a relatively small diameter pulley 524 by means of a belt 526. The small diameter pulley 524 is rotatably mounted on the tube 517 and rotates together with a flywheel 528 about a flywheel axis. Those skilled in the art will recognize that this arrangement may be described as a "stepped up" flywheel assembly, and that a drag strap or other resistance device may be connected to the flywheel 528 (or pulley 522) in order to resist rotation thereof.

A radially displaced end of each crank 520 is connected to an intermediate portion 532 of a respective connector link 530 and cooperates therewith to define a "connector axis" which is radially displaced from the crank axis. A first portion of the connector link 530 extends in a first direction away from the intermediate portion 532 and terminates in a lower end 535. A first distal segment 553 of a foot supporting member 550 is rotatably connected to the first portion of the connector link 530 proximate the lower end 535. A second, opposite distal segment 557 of the foot supporting member 550 is constrained to move in reciprocating fashion relative to said frame 510. In particular, a roller 570 is rotatably mounted on the segment 557 and rolls along a respective base member 515. A third, intermediate segment 555 is sized and configured to support a foot of a standing person.

A second portion 531 of the connector link 530 extends in a second, generally opposite direction away from the intermediate portion 532. The second portion 531 of the connector link 530 is connected to the frame 510 at a connection point disposed a radial distance from the connector axis. In particular, a collar 540 is rotatably mounted on a support 547, and the second portion 531 inserts through the collar 540 and is movable in telescoping fashion relative thereto. In other words, the second portion 531 is movable in translational fashion relative to the collar 540, and the combination is movable in rotational fashion relative to the frame 510, thereby accommodating radial movement of the connector axis relative to the connection point. The second portion 531 terminates in an upper distal end 539 which is sized and configured for grasping by a person standing on the foot supporting member 550.

The support 547 is rigidly secured to a frame member 507 which is selectively movable along the tube 517. In particular, the frame member 507 includes an outer shell which is disposed about the tube 517, a threaded nut which is disposed inside the tube 517, and shafts which connect the nut to opposite sides of the shell. The shafts extend from opposite sides of the nut and through respective elongate slots 505 in the tube 517. A lead screw 506 extends downward through the tube 517 and threads into engagement with the nut. A knob 509 is secured to the upper end of the lead screw 506 to facilitate rotation thereof relative to the tube 517. The lead screw 506 is free to rotate but cannot move axially relative to the tube 517. As a result, rotation of the lead screw 506 causes the nut and the remainder of the frame member 507 to travel axially relative to the lead screw 506 and the tube 517.

The components of the linkage assembly are arranged in such a manner that rotation of the cranks 520 is linked to elliptical motion of the intermediate segments 555 of the foot supporting members 550. The length of the exercise stroke may be increased by moving the collar 540 downward relative to the connector link 530. The (uphill) inclination of the exercise stroke may be increased by moving the tube 517 upward relative to the post 516.

Those skilled in the art will recognize that the present invention may also described in terms of methods (with reference to the foregoing embodiments). For example, the present invention may be seen to provide a method of linking rotation of a crank to generally elliptical movement of a foot supporting member. The method includes the steps of rotatably mounting a crank on a frame; rotatably mounting an intermediate portion of a link on the crank; rotatably connecting an accommodating portion of the link to the frame; rotatably connecting an opposite, fixed length portion of the link to a first end of a foot supporting member; and constraining an opposite, second end of the foot supporting member to move in reciprocating fashion relative to the frame. The method may further include the step of changing the location of the link axis relative to the crank axis, in order to change the path traveled by the foot supporting member.

Those skilled in the art will recognize still more embodiments and/or applications which differ from those described herein yet nonetheless incorporate the essence of the present invention. For example, many of the features which are shown and/or described in specific combinations and/or with reference to specific embodiments may be mixed and matched in other ways and/or applied to other embodiments. Recognizing that the foregoing description sets forth only some of the numerous possibilities, the scope of the present invention is to be limited only to the extent of the claims which follow.

What is claimed is:

1. An exercise apparatus, comprising:

a frame designed to rest upon a floor surface;

a left crank and a right crank, wherein each said crank is rotatably mounted on said frame for rotation about a common crank axis;

a left pivoting link and a right pivoting link, wherein each said pivoting link is a rocker link having a first end pivotally mounted on said frame at a common pivot axis, and an opposite, second end rollably connected to a respective connector link;

a left connector link and a right connector link, wherein each said connector link is rotatably connected to a respective crank, and connected in telescoping fashion to a respective pivoting link;

a left foot support and a right foot support, wherein each said foot support is connected to a respective connector link at a respective point that travels through a generally elliptical path having a major axis length and a major axis orientation; and a means, connected to each said pivoting link, for adjusting at least one of said major axis length and said major axis orientation.

2. The exercise apparatus of claim 1, wherein said means selectively moves said common pivot axis in a generally vertical direction.

3. The exercise apparatus of claim 2, wherein said means also selectively moves said common pivot axis in a generally horizontal direction.

4. The exercise apparatus of claim 1, wherein said means selectively moves said common pivot axis in a generally horizontal direction.

5. The exercise apparatus of claim 1, wherein said means selectively moves said common pivot axis in a first direction to adjust said major axis length, and said means selectively moves said common pivot axis in a second, generally orthogonal direction to adjust said major axis orientation.

6. The exercise apparatus of claim 1, wherein said means includes a common actuator that is connected to both said first pivoting link and said second pivoting link.

7. The exercise apparatus of claim 1, wherein each said connector link is an elongate member that moves through a vertical orientation during rotation of a respective said crank.

8. An exercise apparatus comprising:

a frame designed to rest upon a floor surface;

a left crank and a right crank, wherein each said crank is rotatably mounted on said frame for rotation about a common crank axis;

a left pivoting link and a right pivoting link, wherein each said pivoting link is pivotally mounted on said frame for pivoting about a common pivot axis;

a left connector link and a right connector link, wherein each said connector link is rotatably connected to a respective crank, and connected in telescoping fashion to a respective pivoting link;

a left foot support and a right foot support, wherein each said foot support has a first end rotatably connected to a respective connector link, an intermediate portion sized and configured to support a person's foot, and an opposite, second end constrained to move in reciprocal fashion relative to said frame, and each said foot support is connected to a respective connector link at a respective point that travels through a generally elliptical path having a major axis length and a major axis orientation; and a means, connected to each said pivoting link, for adjusting at least one of said major axis length and said major axis orientation.

9. The exercise apparatus of claim 8, further comprising a left handlebar link and a right handlebar link, wherein each said handlebar link has a lower end rotatably connected to said second end of a respective foot support, an intermediate portion pivotally connected to said frame, and an opposite, upper end sized and configured for grasping.

10. The exercise apparatus of claim 9, wherein each said handlebar link pivots about a common handlebar axis, and further comprising a means for selectively moving said handlebar axis relative to said frame.

11. The exercise apparatus of claim 8, wherein said means selectively moves said common pivot axis in a generally vertical direction.

12. The exercise apparatus of claim 11, wherein said means also selectively moves said common pivot axis in a generally horizontal direction.

13. The exercise apparatus of claim 8, wherein said means selectively moves said common pivot axis in a generally horizontal direction.

14. The exercise apparatus of claim 8, wherein said means selectively moves said common pivot axis in a first direction to adjust said major axis length, and said means selectively moves said common pivot axis in a second, generally orthogonal direction to adjust said major axis orientation.

15. The exercise apparatus of claim 8, wherein said means includes a common actuator that is connected to both said first pivoting link and said second pivoting link.

16. The exercise apparatus of claim 8, wherein each said connector link is an elongate member that moves through a vertical orientation during rotation of a respective said crank.

17. An exercise apparatus comprising:

a frame designed to rest upon a floor surface;

a left crank and a right crank, wherein each said crank is rotatably mounted on said frame for rotation about a common crank axis;

a left pivoting link and a right pivoting link, wherein each said pivoting link is pivotally mounted on said frame for pivoting about a common pivot axis;

a left connector link and a right connector link, wherein each said connector link is rotatably connected to a respective crank, and connected in telescoping fashion to a respective pivoting link;

a left foot support and a right foot support, wherein each said foot support is connected to a respective connector link at a respective point that travels through a generally elliptical path having a major axis length and a major axis orientation; and a means, connected to each said pivoting link, for adjusting at least one of said major axis length and said major axis orientation, wherein said means selectively moves said common pivot axis in a generally vertical direction.

18. The exercise apparatus of claim 17, wherein said means also selectively moves said common pivot axis in a generally horizontal direction.

19. The exercise apparatus of claim 17, wherein each said connector link is an elongate member that moves through a vertical orientation during rotation of a respective said crank.

20. An exercise apparatus comprising:

a frame designed to rest upon a floor surface;

a left crank and a right crank, wherein each said crank is rotatably mounted on said frame for rotation about a common crank axis;

a left pivoting link and a right pivoting link, wherein each said pivoting link is pivotally mounted on said frame for pivoting about a common pivot axis;

a left connector link and a right connector link, wherein each said connector link is rotatably connected to a respective crank, and connected in telescoping fashion to a respective pivoting link;

a left foot support and a right foot support, wherein each said foot support is connected to a respective connector link at a respective point that travels through a generally elliptical path having a major axis length and a major axis orientation; and a means, connected to each said pivoting link, for adjusting at least one of said major axis length and said major axis orientation, wherein said means selectively moves said common pivot axis in a generally horizontal direction.

21. The exercise apparatus of claim 20, wherein each said connector link is an elongate member that moves through a vertical orientation during rotation of a respective said crank.

22. An exercise apparatus comprising:

a frame designed to rest upon a floor surface;

a left crank and a right crank, wherein each said crank is rotatably mounted on said frame for rotation about a common crank axis;

a left pivoting link and a right pivoting link, wherein each said pivoting link is pivotally mounted on said frame for pivoting about a common pivot axis;

a left connector link and a right connector link, wherein each said connector link is rotatably connected to a respective crank, and connected in telescoping fashion to a respective pivoting link;

a left foot support and a right foot support, wherein each said foot support is connected to a respective connector link at a respective point that travels through a generally elliptical path having a major axis length and a major axis orientation; and a means, connected to each said pivoting link, for adjusting at least one of said major axis length and said major axis orientation, wherein said means selectively moves said common pivot axis in a first direction to adjust said major axis length, and said means selectively moves said common pivot axis in a second, generally orthogonal direction to adjust said major axis orientation.

23. The exercise apparatus of claim 22, wherein each said connector link is an elongate member that moves through a vertical orientation during rotation of a respective said crank.

24. An exercise apparatus, comprising:

a frame designed to rest upon a floor surface;

a left crank and a right crank, wherein each said crank is rotatably mounted on said frame for rotation about a common crank axis;

a left pivoting link and a right pivoting link, wherein each said pivoting link is pivotally mounted on said frame and pivots for pivoting about a common pivot axis;

a left connector link and a right connector link, wherein each said connector link is rotatably connected to a respective crank, and connected in telescoping fashion to a respective pivoting link;

a left foot support and a right foot support, wherein each said foot support has a first portion pivotally connected to a respective connector link at a respective point that travels through a generally elliptical path; and a means for constraining a second portion of each said foot support to move in reciprocal fashion relative to said frame.

25. The exercise apparatus of claim 24, further comprising a means for selectively moving said common pivot axis relative to said frame, and thereby causing each said point to travel through a different, generally elliptical path.

26. The exercise apparatus of claim 24, wherein each said pivoting link is a rocker link having a first end pivotally connected to said frame, and an opposite, second end rollably connected to a respective connector link.

27. The exercise apparatus of claim 24, wherein each said foot support has a first end rotatably connected to a respective connector link, an intermediate portion sized and configured to support a person's foot, and an opposite, second end movably connected to said means.

28. The exercise apparatus of claim 27, wherein said means includes a left handlebar link and a right handlebar link, and each said handlebar link has a lower end rotatably connected to said second end of a respective foot support, an intermediate portion pivotally connected to said frame, and an opposite, upper end sized and configured for grasping.

29. The exercise apparatus of claim 24, wherein each said connector link is an elongate member that moves through a vertical orientation during rotation of a respective said crank.

* * * * *